United States Patent [19]

Fink et al.

[11] Patent Number: 5,069,567

[45] Date of Patent: Dec. 3, 1991

[54] CASE

[75] Inventors: Cameron L. Fink; Anthony J. Gentile, both of London, Canada

[73] Assignee: Sterling Marking Products Inc., London, Canada

[21] Appl. No.: 532,548

[22] Filed: Jun. 4, 1990

[30] Foreign Application Priority Data

Jun. 2, 1989 [CA] Canada ..... 601688

[51] Int. Cl.[5] ..... B42F 13/00; B42F 13/40

[52] U.S. Cl. ..... 402/3; 402/80 R; 402/80 P; 402/73

[58] Field of Search ..... 402/3, 73, 80 R, 80 P, 402/73

[56] References Cited

U.S. PATENT DOCUMENTS

| | | | |
|---|---|---|---|
| 3,891,070 | 6/1975 | Montanari | 402/3 X |
| 4,227,328 | 10/1980 | Clipper, Jr. | 402/502 X |
| 4,315,642 | 2/1982 | Ferrichiello | 402/3 X |
| 4,518,275 | 5/1985 | Rauch. III et al. | 402/80 P |
| 4,744,689 | 5/1988 | Sternberg | 402/502 X |
| 4,794,713 | 1/1989 | Yang | 402/502 X |

FOREIGN PATENT DOCUMENTS

| | | | |
|---|---|---|---|
| 8300120 | 1/1983 | World Int. Prop. O. | 402/73 |

*Primary Examiner*—Paul A. Bell

*Attorney, Agent, or Firm*—Rogers & Scott

[57] ABSTRACT

A structur for containing incorporation documents and a corporate seal embosser the structure including a top element of a selected width defining the top and an angled display wall for carrying a sample of a corporate seal to identify the contents of the structure, a fixed side wall dependent from the top structure and of a substantially selected width, a fixed side dependent from both the top and the angled display wall rectangular but for an angled edge shaped to meet the display wall a bottom hinged to the fixed side and of substantially the selected width, a lid hinged to the bottom for movement with the bottom into position in engagement with the fixed side wall and the top element, the lid being of a similar shape to that of the fixed side, a collapsable side wall hinged to the fixed side and of substantially the selected width for movement to meet the lid and the top element when the structure is closed, wall closure means coupled to the collapsable side wall and to the top element to releasably retain this side wall when the structure is closed, and lid closure means coupled to the lid and to the top element to releaseably retain the lid when the structure is closed whereby incorporation documents can be contained when the structure is closed and made available by releasing the closure means, removing the lid, and collapsing the side wall into the plane of the fixed side.

15 Claims, 6 Drawing Sheets

CASE

DESCRIPTION

The present invention relates to a case for storing and carrying incorporation documents with a corporate seal embosser. The invention also provides a blank for making the case and a method of construction.

BACKGROUND OF THE INVENTION

There is a substantial amount of paperwork associated with the incorporation and running of a business, particularly a public corporation which requires share certificates. In addition a corporate seal embosser is often required for printing the seal on legal documents.

Seal embossers can not be stored efficiently in most conventional filing systems and they are usually stored separately from the incorporation documentation. This can lead to storage problems particularly when the incorporation documentation and embosser are held by a lawyer who may also have to store similar documentation and embossers for a large number of corporations. There is also a requirement of confidentiality and it is usually not acceptable for embossers to be left in plain view in a lawyer's office. On the other hand the documentation and embosser belonging to a particular corporation must be readily available for use.

A further practical consideration is the need to transport the documentation with the embosser when meetings are to take place away from the normal place of storage. It is most inconvenient first to find and match the documentation to the embosser and then to carry them, preferably so that they are not evident to be seen by others, as they are being transported. This latter consideration can be most important if the corporation in question is involved in confidential agreements which must, by their very nature, be kept secret.

Thus, it would be desirable to have a storage system for keeping the documentation and embosser together for ready retrieval and for transportation in a manner which protects the client's confidentiality. However, the form of the storage is also important.

It has become acceptable practice to provide some form of case which contains both the documentation and the embosser. However, many law offices store a large number of cases and it is therefore desirable to provide a ready form of identification for each of the cases to facilitate easy selection when looking for a particular case. Preferably a simple identifier should be used which can be seen whether the cases are stood upright on a shelf or contained in a drawer file.

Yet a further consideration is cost. The case must be made to be sufficiently robust for long term use and yet be of reasonable cost because in many instances the startup costs of a new corporation must be kept to a minimum.

SUMMARY OF THE INVENTION

Accordingly, in one of its aspects, the invention provides a structure for containing incorporation documents. The structure includes a top element of a selected width defining the top and an angled display wall for carrying a sample of a corporate seal to identify the contents of the structure. A fixed side wall is dependent from the top structure and is of substantially the selected width, and a fixed side is dependent from both the top and the angled display wall and is rectangular but for an angled edge shaped to meet the display wall.

A bottom is hinged to the fixed side and is substantially of the selected width, and a lid is hinged to the bottom for movement with the bottom into position in engagement with the fixed side wall and the top element. The lid is of a similar shape to that of the fixed side and a collapsible side wall is hinged to the fixed side and is of substantially the selected width for movement to meet the lid and the top element when the structure is closed. Wall closure means is coupled to the collapsible side wall and to the top element to releasably retain this side wall when the structure is closed, and lid closure means is coupled to the lid and to the top element to releasably retain the lid when the structure is closed, whereby incorporation documents can be contained when the structure is closed and then made available by releasing the closure means and moving the lid and the collapsible side wall into the plane of the fixed side.

In another of its aspects, the invention provides a case for use in storing incorporation documents and a corporate seal. The case includes a top element defining a top, a handle coupled to the top element, a bottom spaced from and parallel with the top, a fixed side rigidly attached to the top and hinged to the bottom, a lid hinged to the bottom in parallel with the fixed side, a fixed side wall attached to the fixed side and to the top element, and a collapsible side wall hinged to the fixed side. First closure means coupled to the collapsible side wall and to the top element to releasably retain the collapsible side wall in a closed position and to permit this side wall to be moved into an open position in the plane of the fixed side. A second closure means is coupled to the lid and to the top element to retain the lid in a closed position with the bottom parallel with the top element and to permit the lid and bottom to be moved into an open position in the plane of the fixed side, and ring binder means is coupled to the fixed side to retain loose leaf pages in the case, whereby on moving the lid, bottom and collapsible side wall into the respective open positions, the incorporation documents are available for use.

DESCRIPTION OF THE PREFERRED EMBODIMENT

Figure 1:
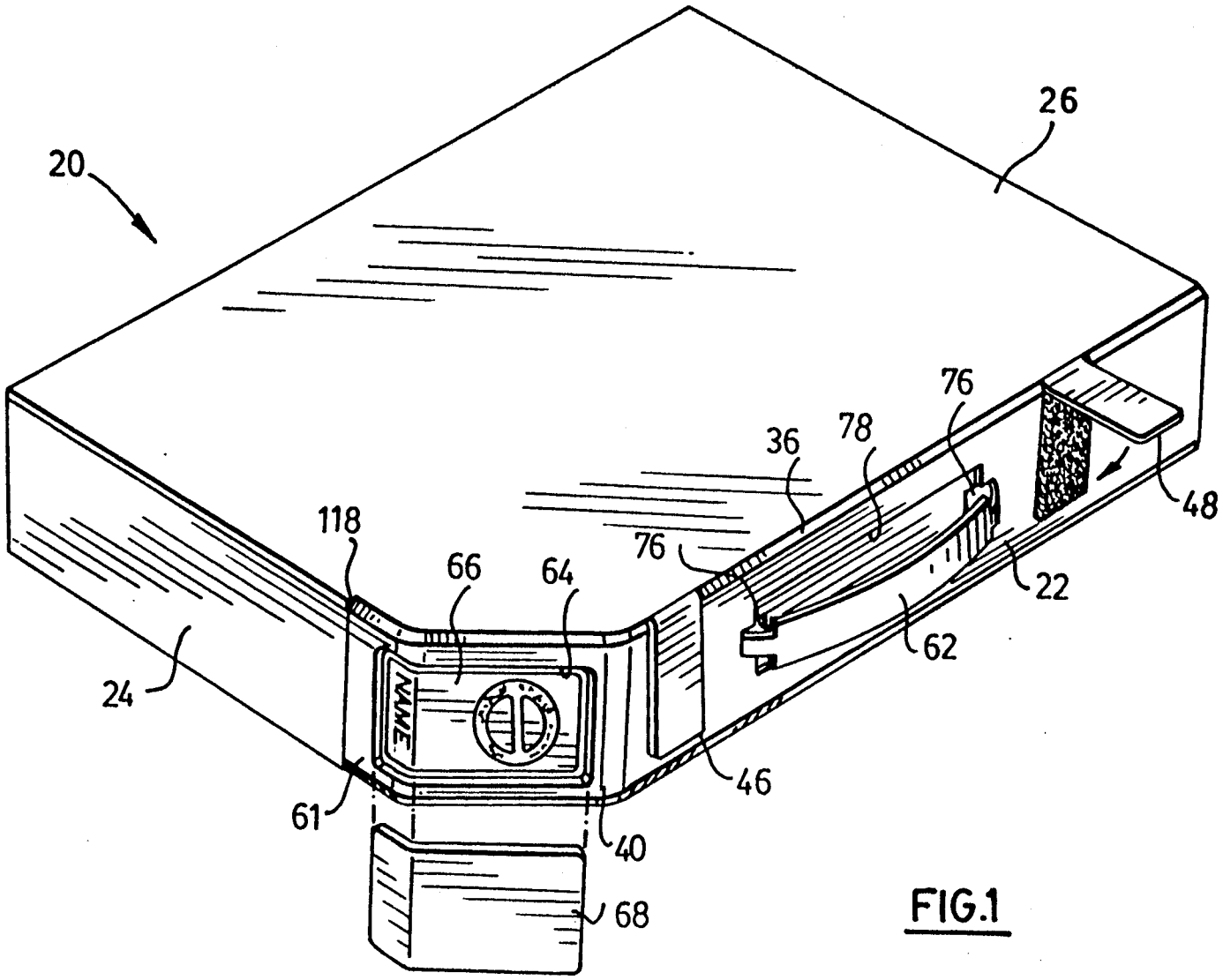
FIG. 1 is a perspective view of a case according to a preferred embodiment of the invention and shown with a portion exploded from the main structure and looking generally from the top and fixed side wall of the case with the case in a closed position.

Reference is made firstly to FIG. 1 which illustrates a case 20 having a top 22, fixed side wall 24, and lid 26. As further seen in FIG. 2, the case also includes a fixed side 30, carrying a conventional ring binder structure 33, a bottom 32 extending between the side 30 and the lid 26 and a box structure 34 which combines with a top element 36 forming part of the top 22 to define the fixed side wall 24 and a display wall 40 angled to extend between the fixed side wall 24 and the top 22. A collapsible side wall 38 is hinged to the fixed side 30 and an internal partition 42 extends between the top element 36 and a short connecting portion 44 which locates the partition 42 relative to the fixed side wall 24.

Figure 2:
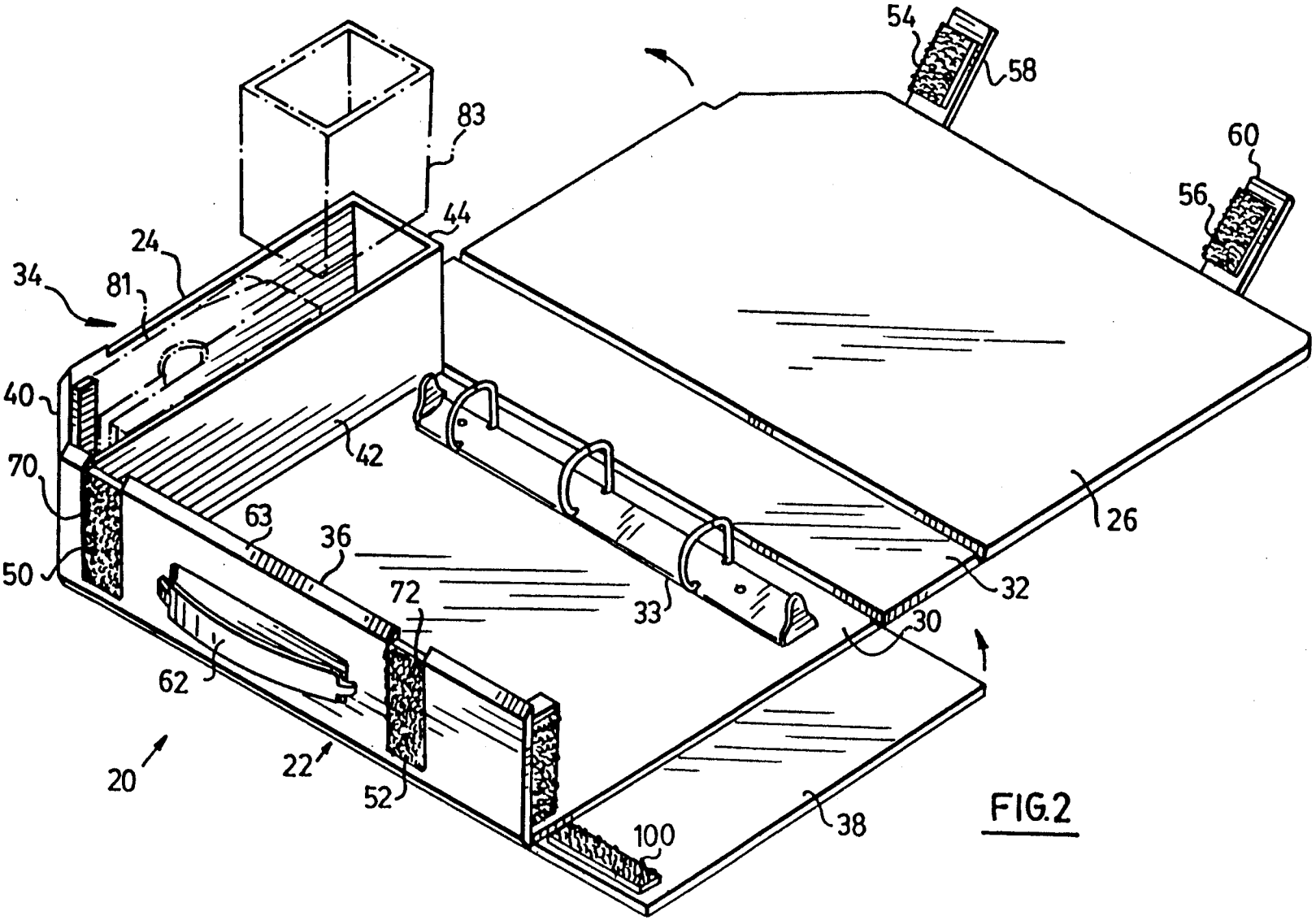
FIG. 2 is a view looking from the top and a collapsible side wall of the case in an opened position ready for use.

It can be seen in FIGS. 1 and 2 that the lid 26 is attached to the top 22 by a pair of fasteners 46, 48 made up of VELCRO (trade mark) materials for example, hook and loop fastening materials having one part in patches 50, 52 and the other part of the material in patches 54, 56 attached to respective flexible straps 58, 60. These straps depend from the lid 26 so that with the lid in a closed position shown in FIG. 1 the VELCRO materials can be brought together to retain the lid in this condition. For illustration the fastener 46 is shown as it would be before closing.

Figure 3:
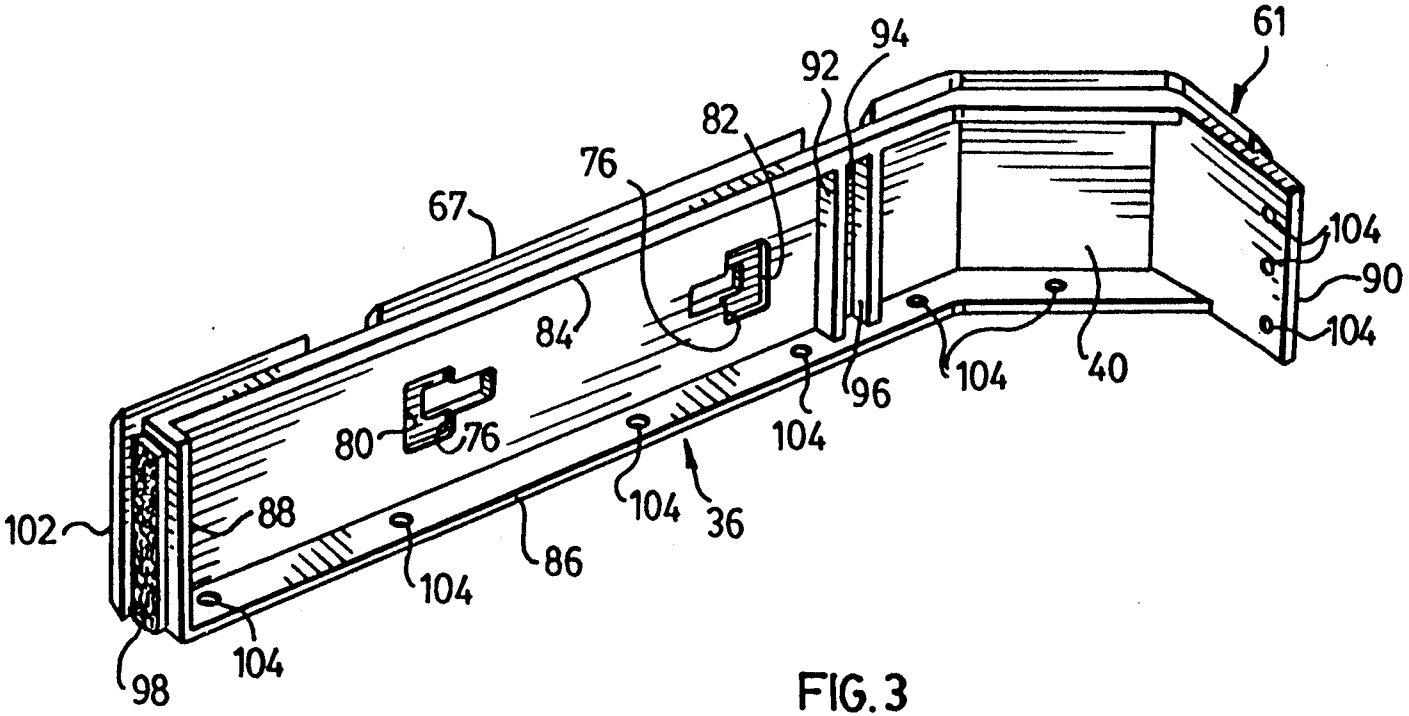
FIG. 3 is a perspective view of a top element used in the construction of the case.

It will be seen from FIGS. 1 and 2 that all of the walls, sides, partitions, etc. are generally rectangular. However, the angled display wall 40 must be accommodated and as a result the fixed side 30 and lid 26 are adjusted from rectangular as will be explained more fully with reference to FIG. 5. Also, although the walls and lid are of board construction, the top element 36 is of injection moulded plastics material and is shown in more detail in FIG. 3.

Before describing FIG. 3, reference is again made to FIG. 1 which shows the element 36 and a handle 62 for use in carrying the case. The element defines the display wall 40 and includes a short extension 61 which makes up part of the fixed side wall 24. A rectangular depression 64 spanning most of both the display wall and the short extension 61 is provided to receive a plaque 66 containing a replica of the seal and company name associated with the particular corporation documentation stored in this case. The plaque 66 is of any suitable material but preferably is of a thin brass material so that it would be a permanent image which is both decorative and easily recognized. A cover plate 68 is provided which can be snapped into the depression 64 to cover the plaque 66 should it be necessary to transport the case in conditions where it would be important that observers did not see the plaque.

It should also be noted that the element 36 is formed so that in the top 22 a pair of depressions are provided to receive the VELCRO patches 50, 52. This is better seen in FIG. 2 where the respective depressions 70, 72 can be seen. These depressions are of a depth sufficient to ensure that the VELCO patches 50, 52 are flush with the top 22 for minimum interference when the case is opened.

Figure 4:
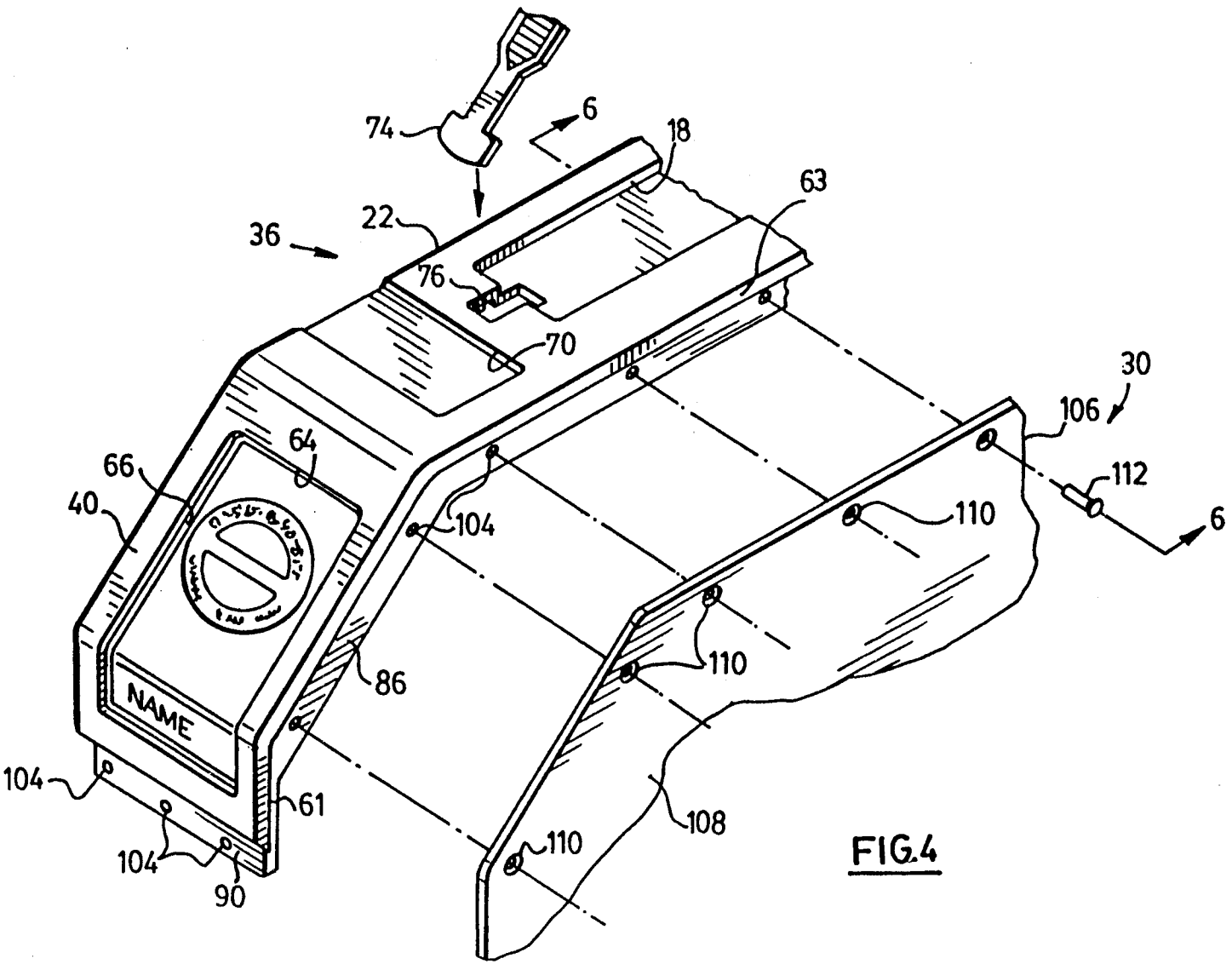
FIG. 4 is an exploded perspective view illustrating construction of the case and showing part of the top element.

The handle 62 is in the form of a strap with spade ends, one of which can be seen at 74 in FIG. 4. This is a conventional form of handle which is engaged in suitable openings 76 by twisting the handle and inserting the spade ends. The handle will return to its natural condition trapping the spade ends so that the handle can be used to carry the case. An elongate depression 78 is provided so that the handle can lie generally flush with the top 22 when not in use.

The case is completed by providing documentation (not shown) on the ring binder structure 33 and a seal embosser 81 shown in ghost outline in FIG. 2. Also if preferred a simple receptacle 83 can be added to receive, among other things the cover plate 68 when not in use.

Reference is again made to FIG. 3 which illustrates the element 36 from the inside of the case. Here it will be seen that the handle openings 76 are of conventional form and project through the element so that the spade ends 74 of the handle would be contained in recesses 80, 82. The top and bottom peripheries of the element 36 are supported by an upper elgonate rib 84 and a slightly wider rib 86 which terminate at one end in a transverse end portion 88 and at the other end, they extend around the display wall 40 terminating at the short extension 61 which extends to form part of the fixed side wall 24. A connecting portion 90 is secured to the end of the short extension 61. Intermediate the ends, a pair of transverse ribs 92, 94 are provided to define a slot 96 for receiving an end of the partition 42 as will be explained in subsequent description.

The end portion 88 is provided to carry a patch of VELCRO 98 and is positioned so that a complementary patch 100 (FIG. 2) on the collapsible side wall 38 can be received by the patch 98 and this end wall will rest snugly against abutting surface 102 of the element 36.

The rib 86 and connecting portion 90 are sized to provide a plurality of openings 104 which are used for connecting the fixed side 30 and fixed side wall 24 as will be described in more detail later. Although not seen in this view, the ribs are positioned so that with the side wall attached, the end of the side wall will butt against the top 22 just as the lid 26 will also butt against the top when it rests on the rib 84. This can be seen in FIG. 1 where the top 22 shows at the termination of the lid 26.

Figure 6:
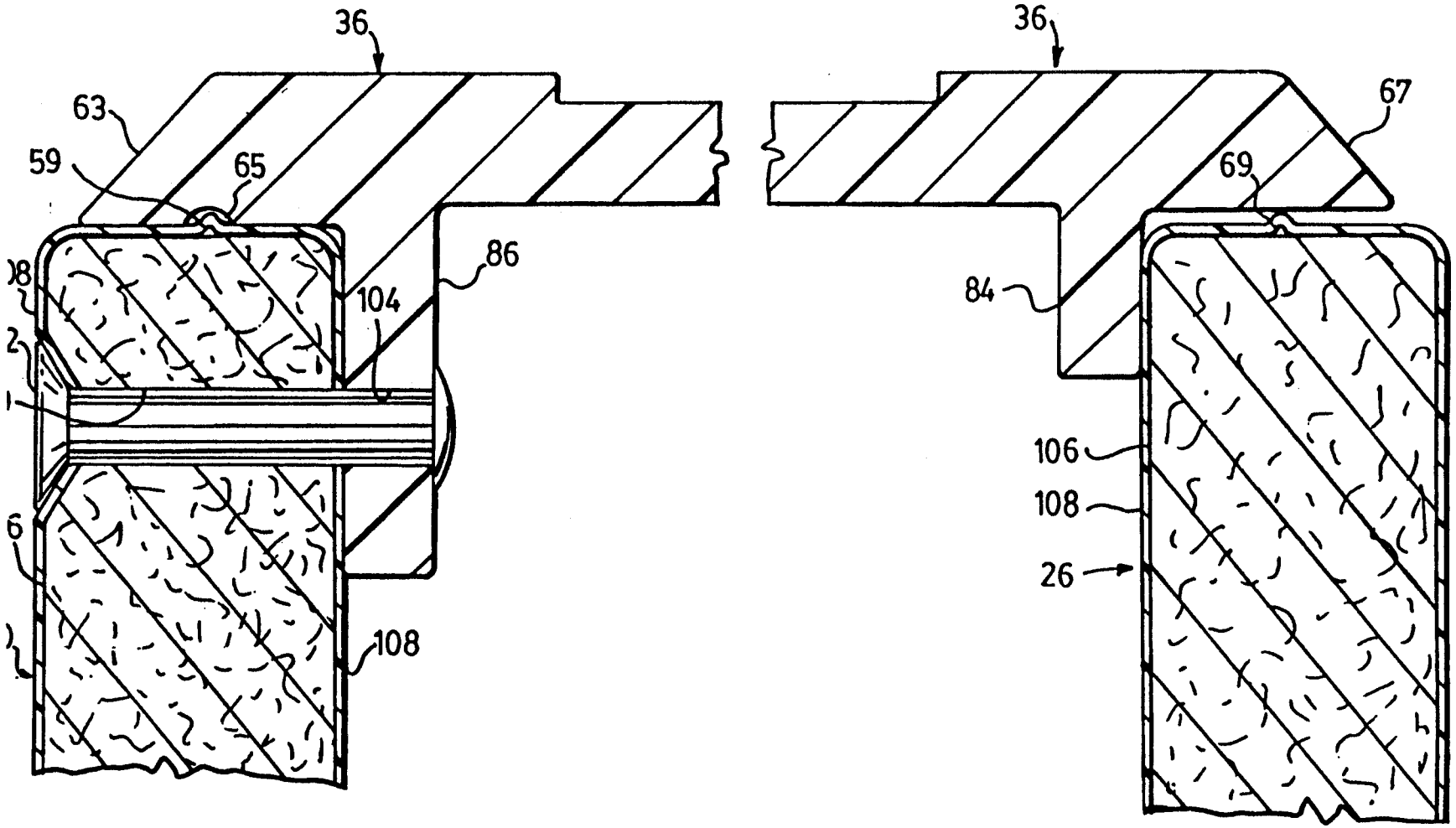
FIG. 6 is a cross-sectional view along line 6—6 of FIG. 4 and drawn to a larger scale.

Reference is now made to FIG. 4 to further illustrate this connection. FIG. 4 illustrates the element 36 from the end carrying the short extension 61 and angled display wall 40. The rib 86 can be seen ready to receive the side 30 which is made up of a fibreboard portion 106 covered on each side by a covering of vinyl sheeting or other suitable material 108 (not shown), the coverings being sealed around the edges of the fibreboard portion 106 to provide an envelope as better seen in FIG. 6. In FIGS. 4 and 6 it can be seen that the element 36 has a beveled overlapping lip 63 which covers the end of the side 30. This overlapping lip 63 defines a recess 65 on the inner side thereof to receive a sealed edge 59 of the envelope which projects outward from the side 30. The side 30 has a plurality of openings 110 to receive thermoplastic rivets 112 (one of which is shown) which engage through the openings 110 and then through the openings 104 in the element 36. The rivets are finished by heating the ends inside the element 36 to retain them in position. The pressure of the sealing operation countersinks the heads of the rivets flush with the side 30.

A similar procedure is used to attach the fixed side wall 24 to the connecting portion 90 using further ones of the openings 104.

On the opposite side of element 36 from the lip 63 there is a second beveled lip 67 which covers the edge of lid 26 as can be seen in FIG. 6. The lip 67 is positioned so that there is enough clearance for the lid 26 to swing between the open and closed positions without catching a sealed edge 69 located on the lid 26.

Figure 5:
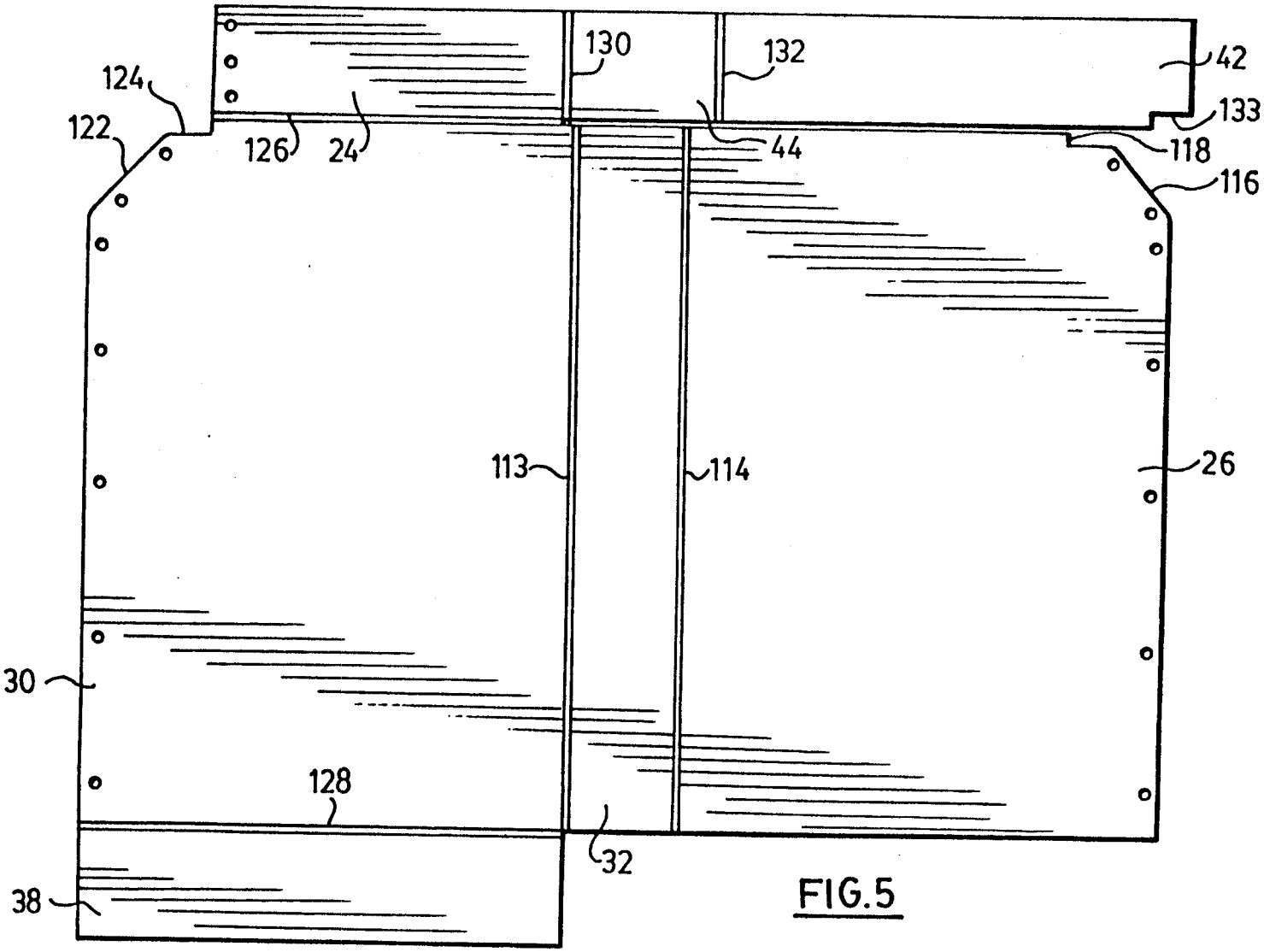
FIG. 5 is a plan view of a blank used in the construction of the case.

Conveniently the structure is made using a multi-section blank covered by sheeting 108. A suitable blank is shown in FIG. 5. Starting at the center, the elongate rectangular bottom 32 is bordered on its longer sides by hinge structures 113, 114 which extend in parallel and connect the bottom 32 respectively to the side 30 and to the lid 26. The structure of these and other hinge structures is conventional and is made up of board stock of some kind covered on both sides with a thin flexible material such as VINYL, the board stock ending just short of the hinge structure with the sides of the envelope sealed together to hold the board stock in place so that the flexibility is provided by the VINYL.

The lid 30, as mentioned previously is generally rectangular but is shaped at one corner to provide an angled edge 116 ending at a step 118. This step is shaped to allow the lid to meet both the side wall 24 and the top element 36 neatly without leaving gaps. This engagement can best be seen in FIG. 1. Similarly, an angled edge 122 is provided on the side 30 together with a step 124. This is again to ensure clean and accurate relationships with the wall 38 and top element 36. The fixed side 30 is attached at respective hinges 126, 128 to the fixed side wall 24 and to the collapsible side wall 38. In turn the rectangular wall 24 is attached at a hinge 130 to connecting portion 44 which in turn is connected to partition 42 by a hinge 132. The portion 44 and partition 42 are connected to one another and to the fixed side wall 24 but are not otherwise connected to the blank. Also, it should be noted that the hinge 130 is out of alignment with hinge 112 sufficient to permit folding such that the portion 44 does not interfere with movement of the bottom 32 as that part is folded upwardly to bring the lid into proper registration to close the case.

A partition 42 ends at its distal end in a notch 133 designed to accommodate the rib 86 (FIG. 3) of the top element when the distal end of the partition is engaged in the slot 96 formed for that purpose. During assembly this end of the partition receives adhesive so that it will retain its position in the slot after assembly.

To assemble the case, the blank shown in FIG. 5 is first prepared and then the ring binder structure 33 (FIG. 2) is attached to the fixed side 30 using suitable rivets. Next, the top element 36 is attached to the fixed side 30 and to the fixed side wall 24 with the blank otherwise remaining in a flat condition. Once this has been done, the partition 42 is moved using the hinges 130, 132 to bring the distal end of the partition into engagement in the slot 96 shown in FIG. 3. As mentioned previously, adhesive will be used during this part of the assembly. This completes the formation of the box structure 34 (FIG. 2) and next, the VELCRO parts are assembled to make the closures which permit the lid to be brought into a closed position and held in place and also to permit the collapsible side wall 38 to be brought into registration with the top element 36 and retained in that position.

In situations where the display wall is to receive an identification of some kind, this is prepared and placed in the depression 64 in the display wall. Conveniently this identification would be in a form made by the seal embosser 81 (FIG. 2) previously described. Cover plate 68 would be provided for later use if required. The case along with seal press is shown in ghost outline in FIG. 2.

The various parts of the VELCRO are attached to form the closures and the handle 62 attached. The structure is then ready for use.

This and other embodiments of the invention are within the scope of the claims.

We claim:

1. Structure for containing incorporation documents, the structure comprising:

a top element of a selected width defining the top and an angled display wall, said wall comprising means to identify the contents of the structure;

a fixed side dependent from both the top and the angled display wall and being rectangular but for an angled edge shaped to meet the display wall;

a fixed side wall dependent from the top structure and being of substantially said selected width;

a bottom hinged to the fixed side and being substantially of the selected width;

a lid hinged to the bottom for movement with the bottom into position in engagement with the fixed side wall and the top element, the lid being of a similar shape to that of the fixed side;

a collapsible side wall hinged to the fixed side and of substantially said selected width for movement to meet the lid and the top element when the structure is closed;

means for retaining incorporation documents within said structure;

wall closure means coupled to the collapsible side wall and to the top element to releasably retain this side wall when the structure is closed; and lid closure means coupled to the lid and to the top element to releasably retain the lid when the structure is closed, whereby incorporation documents can be contained when the structure is closed and then made available by releasing the closure means and moving the lid and the collapsible side wall into the plane of the fixed side.

2. Structure as claimed in claim 1 and further including a partition parallel to the fixed side wall to receive and store a corporate seal embosser between the fixed side wall and the partition.

3. Structure as claimed in claim 2 and further including a connecting portion between the fixed side wall and the partition immediately adjacent the bottom.

4. Structure as claimed in claim 3 in which the connecting portion is hinged to the fixed side wall and to the partition.

5. Structure as claimed in claim 2 and further including a receptacle contained between the partition and the fixed side wall.

6. Structure as claimed in claim 1 in which the top element is a moulding of synthetic plastic material.

7. Structure as claimed in claim 1 said retaining means comprising ringed binder structure attached inside the structure to receive loose-leaf pages.

8. Structure as claimed in claim 1 and further including a handle attached to the top element.

9. Structure as claimed in claim 1 in which the closure means is of hook and loop fastening material.

10. Structure as claimed in claim 1 in which the display wall defines a depression and in which the structure further includes a representation of a corporate seal contained in the depression and identifying the incorporation documents contained in the structure.

11. Structure as claimed in claim 10 and further including a cover plate for attachment to the angled display wall to selectively cover or expose the representation of a corporate seal.

12. A case for use in storing incorporation documents and a corporate seal, the case comprising:

a top element defining a top;

an angled display wall forming part of the top, said wall comprising means to identify the contents of the structure;

a handle coupled to the top element;

a bottom spaced from and parallel with the top;

a fixed side rigidly attached to the top and hinged to the bottom;

a lid hinged to the top in parallel with the fixed side;

a fixed side wall attached to the fixed side and to the top element;

a collapsible side wall hinged to the fixed side;

first closure means coupled to the collapsible side wall and to the top element to releasably retain the collapsible side wall in a closed position and to permit this side wall to be moved into an open position in the plane of the fixed side;

second closure means coupled to the lid and to the top element to retain the lid in a closed position with the bottom parallel with the top element and to permit the lid and bottom to be moved into an open position in the plane of the fixed side; and ring binder means coupled inside the case to retain loose leaf pages in the case, whereby on moving the lid, bottom and collapsible side wall into the respective open positions, the incorporation documents are available for use.

13. A case as claimed in claim 12 in which the top element includes a display wall angled with respect to the top and the fixed side wall and attached to the fixed side wall.

14. A case as claimed in claim 13 and further including means identifying the contents of the case attached to the display wall.

15. A case as claimed in claim 14 and further including a cover plate for attachment to the angled display wall to selectively cover or expose the identifying means.

* * * * *